US006056040A

United States Patent [19]

Weaver et al.

[11] Patent Number: 6,056,040

[45] Date of Patent: May 2, 2000

[54] MOULD DEVICE WITH ADJUSTABLE WALLS

[75] Inventors: Clark Howard Weaver, Chicoutimi; Pierre Marchand, Longueuil; Yves Charbonneau, Mont St-Hilaire, all of Canada

[73] Assignee: Alcan International Limited, Montreal, Canada

[21] Appl. No.: 09/160,285

[22] Filed: Sep. 24, 1998

Related U.S. Application Data

[60] Provisional application No. 60/061,507, Oct. 10, 1997.

[51] Int. Cl.[7] ..... B22D 11/04

[52] U.S. Cl. ..... 164/436; 164/491

[58] Field of Search ..... 164/436, 491

[56] References Cited

U.S. PATENT DOCUMENTS

| | | | |
|---|---|---|---|
| 4,085,793 | 4/1978 | Scheinecker et al. | 164/436 |
| 4,516,622 | 5/1985 | Thone et al. . | |
| 4,719,966 | 1/1988 | Rohrig | 164/491 |
| 5,146,975 | 9/1992 | Negishi . | |
| 5,205,345 | 4/1993 | McClellan et al. | 164/491 |
| 5,249,622 | 10/1993 | Dalimonte | 164/491 |

FOREIGN PATENT DOCUMENTS

| | | | |
|---|---|---|---|
| 59-27672 | 7/1984 | Japan . | |
| 62-009747 | 1/1987 | Japan . | |
| 6-234046 | 8/1994 | Japan | 164/436 |
| 2078147 | 1/1982 | United Kingdom | 164/491 |

OTHER PUBLICATIONS

Kunitoshi Takagi et al., "Development of Adjustable Mold Technology", Light Metals 1993, pp. 701–707.

*Primary Examiner*—Kuang Y. Lin
*Attorney, Agent, or Firm*—Cooper & Dunham LLP

[57] ABSTRACT

A casting apparatus is described for casting metal ingots of rectangular shape comprising a mould assembly mounted on a casting table. The mould assembly has a pair of opposed, outwardly curved long walls and a pair of opposed short walls defining a rectangular mould cavity. Both the opposed short walls and the opposed long walls are moveable to change the size of the cast ingot with the long walls being independently moveable from the short walls. Operative means are provided for simultaneously moving the opposed long walls symmetrically about the centre-line of the mould cavity in both inward and outward directions, and a vertically moveable bottom block is provided which is adapted to move downwardly and support a forming ingot.

17 Claims, 5 Drawing Sheets

MOULD DEVICE WITH ADJUSTABLE WALLS

CROSS-REFERENCE TO RELATED APPLICATIONS

This application claims the benefit of U.S. Provisional Application No. 60/061,507, filed Oct. 10, 1997.

FIELD OF THE INVENTION

This invention relates generally to the field of casting moulds and, more particularly, to the field of direct chill casting moulds with adjustable mould walls.

BACKGROUND OF THE INVENTION

Conventional fixed moulds have been used for many years for casting rectangular sheet ingots. Aluminum sheet is used in many different fields and there has been an increasing demand for sheet of different widths. This in turn has created an increasing demand for ingots of different dimensions.

In a direct chill casting system, aluminum or other molten metal is poured into the inlet end of an open-ended mould while liquid coolant is applied to the inner periphery of the mould to cool the mould walls and generate primary cooling. Also, the same or different coolant is normally applied as secondary cooling to the surface of the ingot as it emerges from the outlet end of the mould, to continue the cooling effect on the solidifying metal. The coolant is applied around the periphery of the mould or a portion thereof, as well as to the faces of the emerging ingot, to make the cooling effect as uniform as possible.

Because of the high coefficient of thermal expansion of aluminum, in order to obtain flat ingots, moulds have been devised which are capable of forming a crown on the longer side walls of a rectangular ingot to compensate for uneven wall distortion which these side walls experience as the ingot solidifies. Thus, the long walls of the rectangular mould are typically outwardly curved. A slight curvature may be imposed on moulds for casting steel, but it is substantially less than that required for metals such as aluminum.

Because of the relative complexity of the mould systems as described above and the fact that the walls of the mould also carry coolant, it will be recognized that it is not a simple matter to design such a mould assembly having adjustable side walls. Thone et al. U.S. Pat. No. 4,516,622 discloses a straight sided mould used for steel in which hydraulic cylinders can move the long walls with respect to the mould frame. The hydraulic cylinders are disposed symmetrically on either side of the centre line of the mould but they are unidirectional and are designed merely to clamp the side wall to the ends in use. Although the side walls are independent of the end walls, in fact the end walls are precisely fixed with respect to the mould centre line so that in use, the side walls become positioned with respect to the centre line by the action of the end walls.

Negishi, U.S. Pat. No. 5,146,975 describes a variable-width mould device for casting aluminum in which the long walls of the mould are outwardly curved. The end walls are held in position by sliding guides which contain water feeds. The side walls are attached to the end walls and therefore move in relationship to the movement of the end walls. The positioning of the side walls with respect to the bottom block is dependent on maintaining the end wall in position with respect to the bottom block, which requires no sideways flexibility in the connections between the moveable end walls and the frame.

It is the object of the present invention to provide a casting apparatus for casting metal ingots of rectangular shape in which both the opposed long (side) walls and opposed short (end) walls of the mould are easily and precisely moveable.

SUMMARY OF THE INVENTION

The present invention in its broadest aspect relates to a casting apparatus for casting metal ingots of rectangular shape comprising a mould assembly mounted on a casting table. The mould assembly has a pair of opposed, outwardly curved long walls and pair of opposed short walls defining a rectangular mould cavity with the opposed short walls being movable to change the size of the cast ingot. A vertically moveable bottom block is adapted to move downwardly and support a forming ingot. The invention is characterized by the fact that the long walls are independently moveable from the short walls to change the size of the cast ingot and moreover, operative means are provided for simultaneously moving the opposed long walls symmetrically about the centre line of the mould in both inward and outward directions.

The opposed short walls are typically mounted in continuously adjustable clamps which permit continuous adjustment of the positions of the end wall between the desired limits of travel. A typical such clamping arrangement may consist of slots which limit the distance of movement of the walls and these walls can be fixed in position in the slots by means of screw clamps. The opposed long walls may also be equipped with similar continuously adjustable clamps to improve reliability.

DESCRIPTION OF THE PREFERRED EMBODIMENTS

The operative means for simultaneously moving the opposed long walls is preferably a device or combination of devices which move each wall inwardly or outwardly in synchronized fashion. Pairs of linear position actuators (electrical or hydraulic) may be used, but it is preferred that the means be a purely mechanical means, e.g. based on a screw, worm gear or toggle clamp arrangement. Regardless of the type of linear actuator or mechanical device, it is important that they operate both inwardly and outwardly in a synchronized manner so that at all times the long walls are symmetrically disposed about the centre line of the mould. A preferred means is in the form of a pair of actuating shafts with threaded end portions extending across between the long walls at opposite ends thereof. These threaded shafts are rotatable while being fixed against axial movement and the threaded end portions of the shafts engage threaded bolts connected to the long walls. The threaded end portions of the shafts are preferably in the form of internally threaded holes extending axially into the ends of the shaft. The threaded bolts connected to the long walls are typically in the form of bolt members connected to the long walls by flexible couplings. Preferably, each bolt member connected a long wall comprises a threaded bolt with a rod end having a clevis pin mounted through it, the clevis pin being engaged by a hole in a clevis bracket fixed to the long wall. The clevis pin is preferably mounted in a slotted or elongated hole in the clevis bracket to thereby allow for some lateral play between the actuating shaft and the bracket. The actuating shaft also typically has a knurled surface or handwheel member fixed thereto for rotating the shaft and thereby adjusting the long wall.

Preferably, the short walls of the mould are suspended from sliding support plates which are adapted to slide along the top surfaces of the long walls. Typically, the top surface of a long wall is the top surface of an oil plate mounted thereon.

These support plates also serve to provide a secure contact between the short walls and the long walls of the mould. Thus, each support plate may include a surface which is adapted to bear against an oil plate of a long wall. The surface preferably includes a sealing material which assists in sealing the adjacent oil grooves and thereby preventing oil leaks.

According to another preferred embodiment, the mould short walls are provided with coolant deflectors at the ends thereof, i.e. at the corners adjacent the long walls. The deflectors serve to deflect coolant away from the corners of the ingot while it is being cast.

According to another preferred feature of the invention, a special type of bottom block is used. This includes end sections which are moveable to lengthen or shorten the block, these end sections being slidable by way of tongue and groove supports. Spacers are also provided for inserting between the end sections and the remainder of the bottom block.

BRIEF DESCRIPTION OF THE DRAWINGS

The invention will be more fully understood from the following description of certain preferred embodiments thereof, given by way of example only, with reference to the accompanying drawings, in which:

FIG. 1 shows generally a casting table 10 with a mould assembly 11 mounted thereon. The casting table includes hollow frame sections 12 which are used to deliver coolant to the moulds themselves. This can be seen in greater detail in FIG. 3 where the coolant is delivered via flexible hoses 13 from the frame sections 12 to the mould 11.

The mould 11 consists of a pair of opposed long (side) walls 14 and a pair of opposed short (end) walls 15. The long walls 14 are slightly outwardly curved typically creating a change in mould width of 1 to 1.5 mm per side for each 50 mm of distance along the mould in the region in which the end walls are to be adjusted. The opposed short walls may also be slightly curved, flat or any profile required by the nature of the product.

Figure 2:
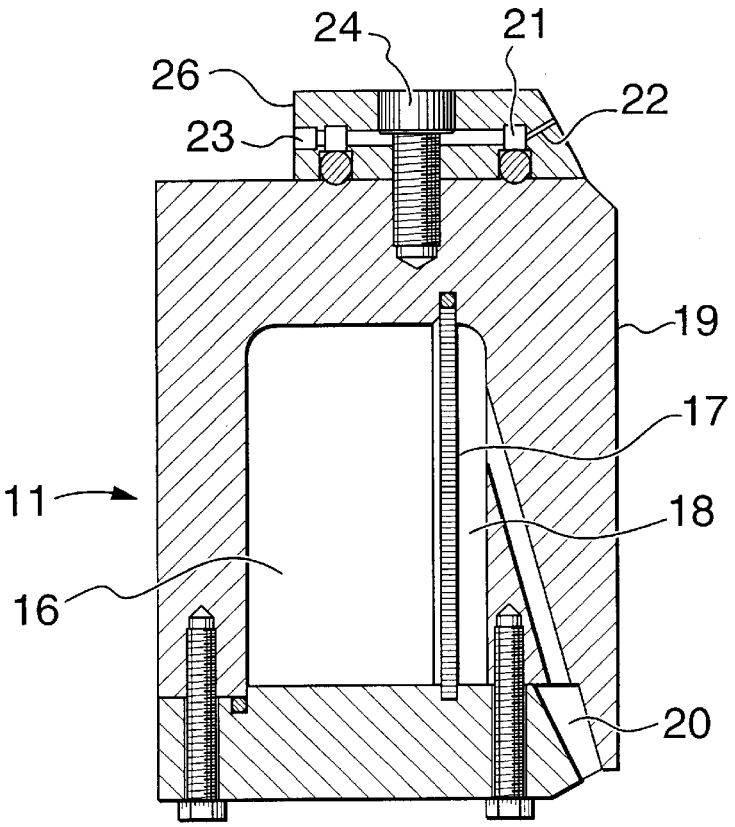
FIG. 2 is a sectional view of a side or end wall of the mould.
Figure 3:
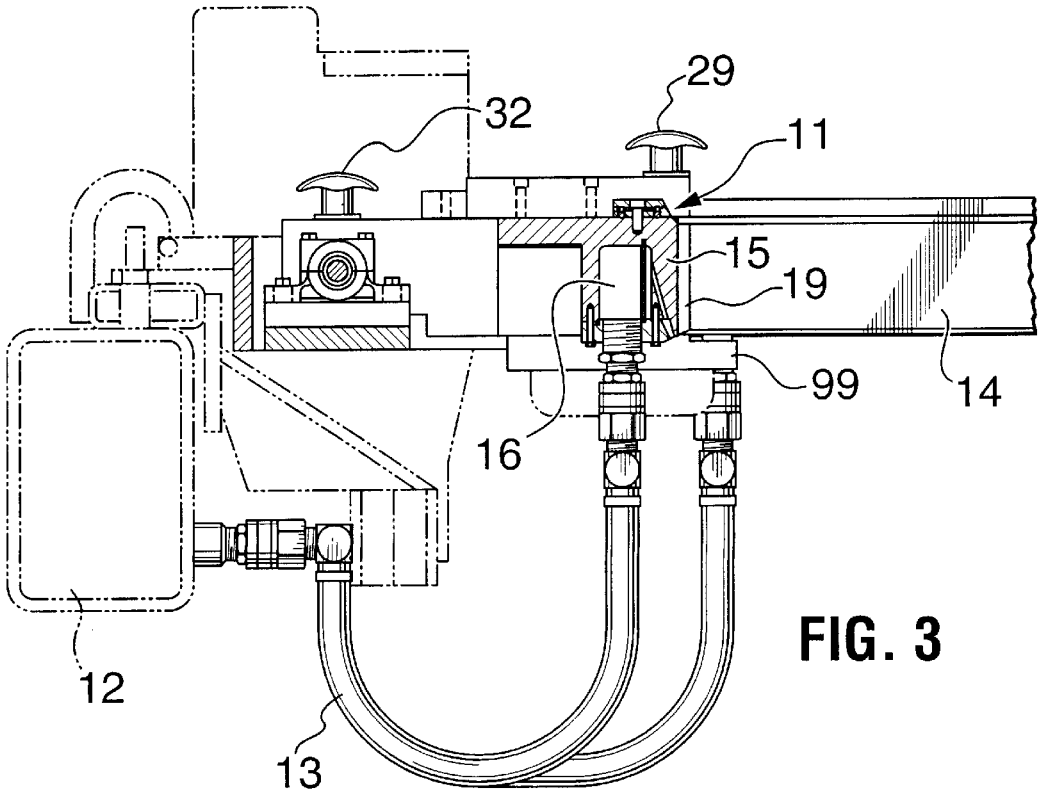
FIG. 3 is a cross-sectional view of a casting table and short side section of the mould.

A typical cross-section of a mould 11 is shown in FIG. 3 and in more detail in FIG. 2. It will be seen that the mould has a hollow cross-section serving as a coolant chamber. This chamber has a main portion 16 to which a flexible hose 13 is connected and includes an internal baffle 17 used to improved the coolant flow uniformity and a secondary chamber 18 through which the coolant flows at high velocity and then out through outlet openings 20. The high flow in the secondary chamber 18 improves the heat transfer thereby insuring good cooling of the mould face 19. The opening 20 is in the form of a continuous slot through which the coolant impinges on the ingot surface (not shown) to provide the necessary secondary cooling of the ingot during casting. Mould designs using openings in the form of a series of holes may also be used.

The top surface of the mould 11 includes an oil plate 26 containing interconnected oil channels 21 running parallel to the mould face which in turn feed lubricant to the casting face by means of a series of small passageways 22. It is fed from an oil supply system (not shown) by means of a flexible hose connected at inlet connector 23. The oil plate 26 is fixed to the top of the mould by means of a series of bolts 24 (also seen in FIG. 1). Oil plates of this type are described in U.S. Pat. No. 5,033,535 (Leblanc et al.).

Figure 1:
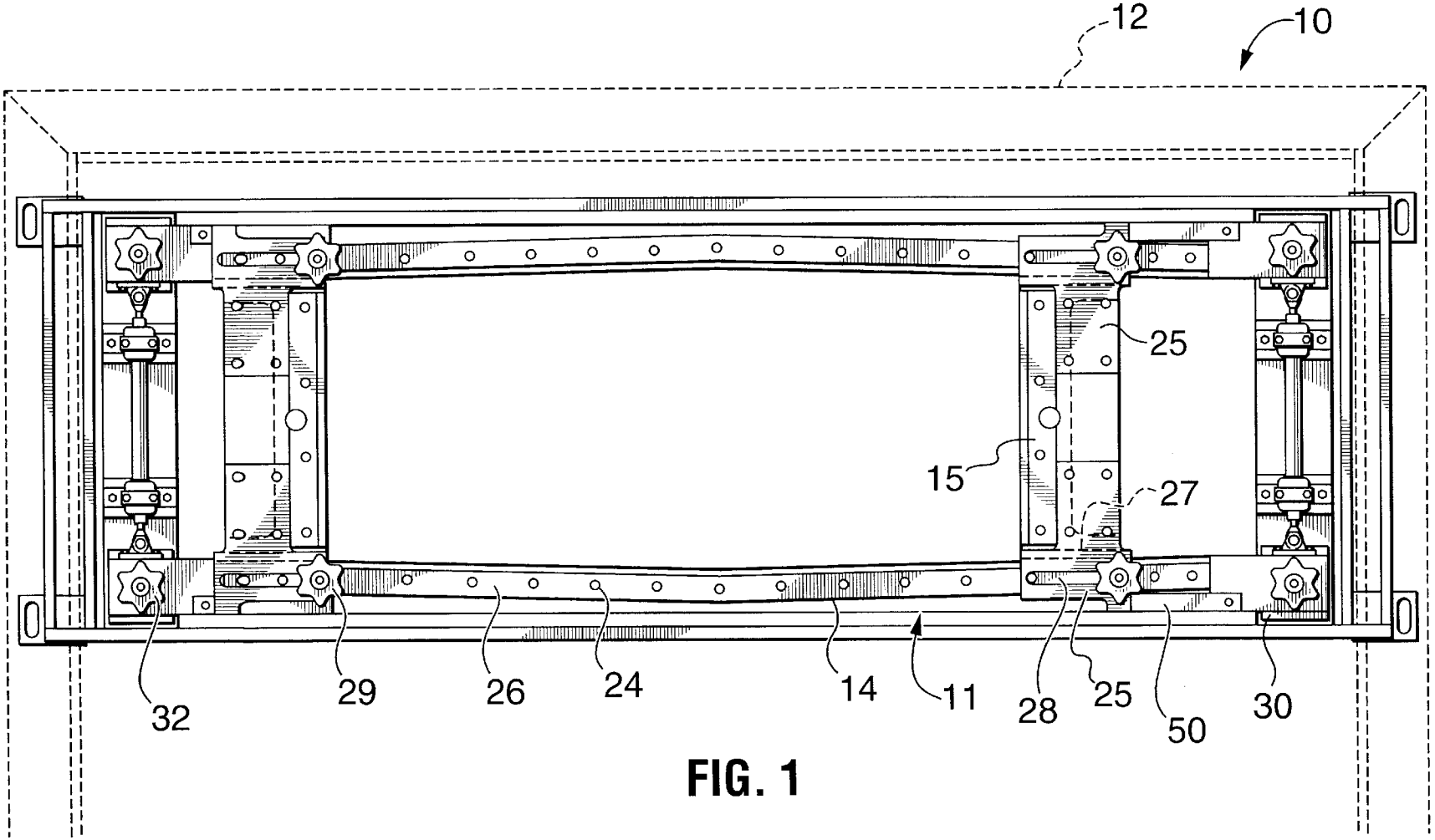
FIG. 1 is a plan view of a casting assembly to the invention.
Figure 6:
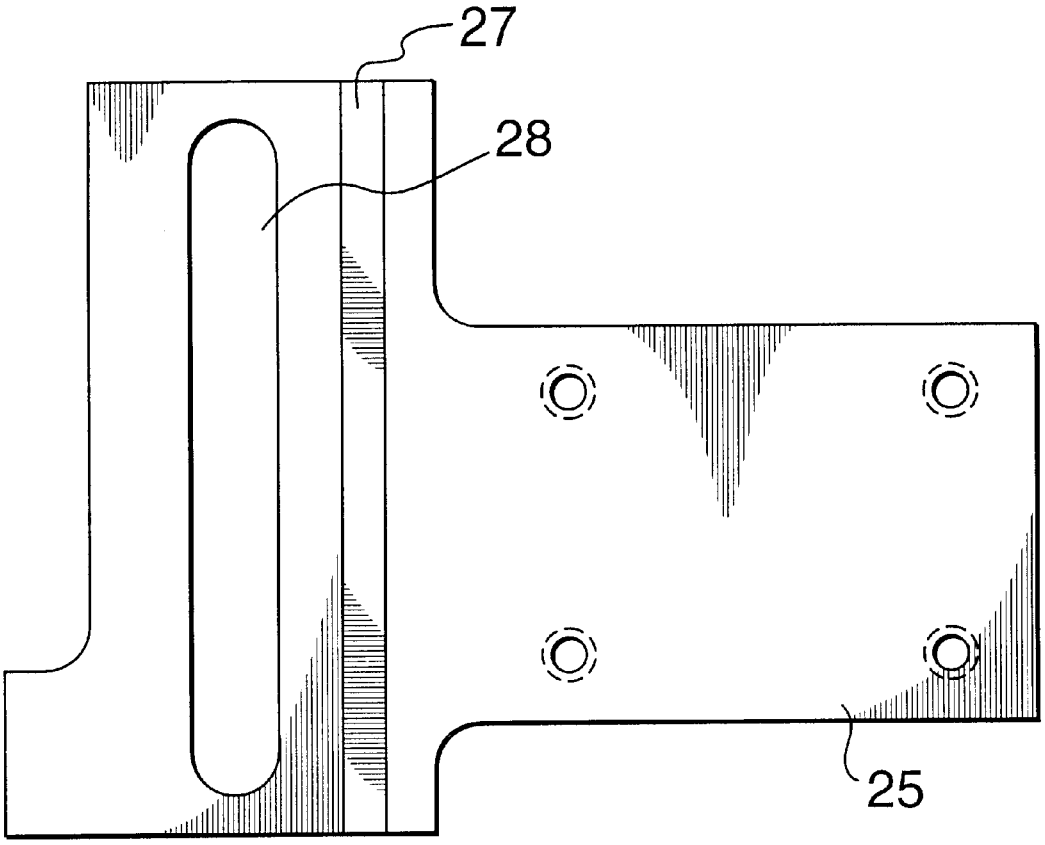
FIG. 6 is a plan view of an extending bracket for short wall.
Figure 7:
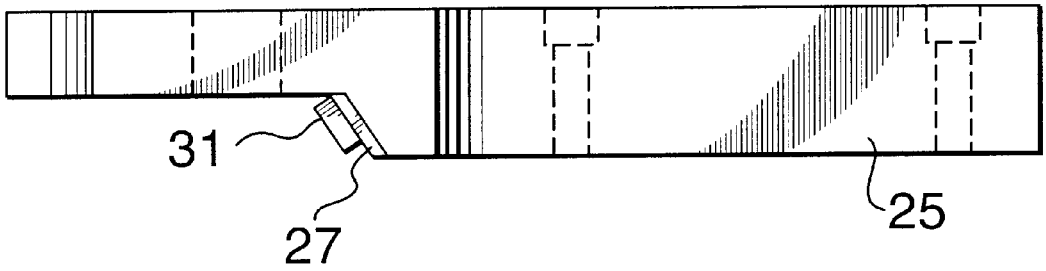
FIG. 7 is a sectional view of the bracket of FIG. 6.

From FIG. 1, it will also be seen that the short walls 15 of the mould are suspended from slidable supports 25 which can slide along the top surface of the oil plate 26 mounted on the long wall 14. The slidable support 25 (shown in greater detail in FIGS. 6 and 7) includes a beveled surface 27 which can bear against an oil plate of the long walls 14. A sealing material 31 is provided on these surfaces which, when the surfaces bear against the oil plate of the mould, seal the oil grooves 22 in that section and prevent oil leaks. The sliding supports 25 have elongated slots 28 which mate with vertical posts of screw clamps 29 mounted on the long walls 14 of the mould. These slots 28 and screw clamps 29 form a continuously adjustable clamping arrangement which permits an in/out movement of the short walls 15 of the mould of about 175 mm for each short (end) wall. This provides a potential range of ingot sizes covering a variation of 350 mm. The slots are made substantially wider than the posts of the screw clamps and therefore do not unduly constrain the in/out movement of the long walls of the mould when the screw clamps are released.

The short walls 15 of the mould may also be provided with water deflectors 99 in the corners so that in any position of the short wall of the mould, secondary coolant is deflected away from the corners of the ingot while it is being cast, thus avoiding the need to plug and unplug water holes depending on mould size selected.

Figure 4:
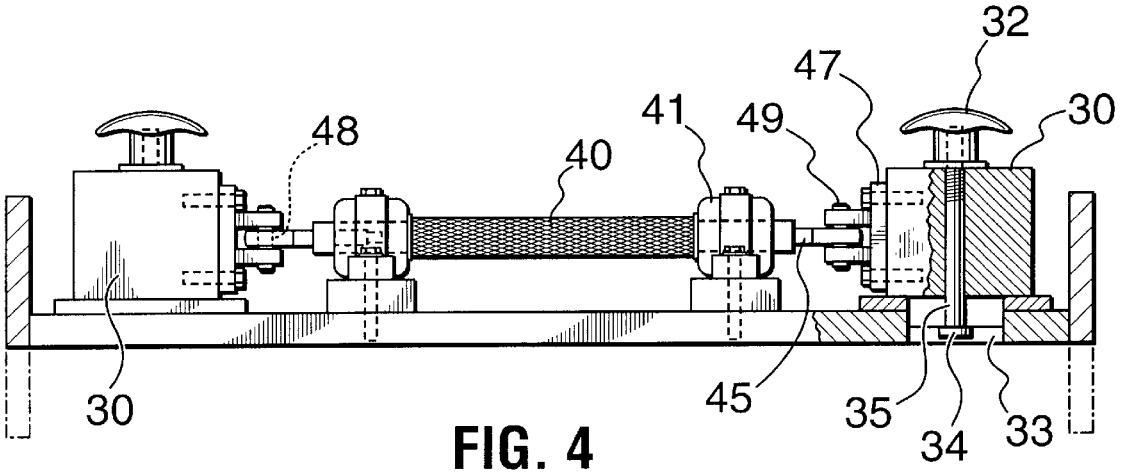
FIG. 4 is an elevation view in partial section of an actuator for moving the long walls.
Figure 5:
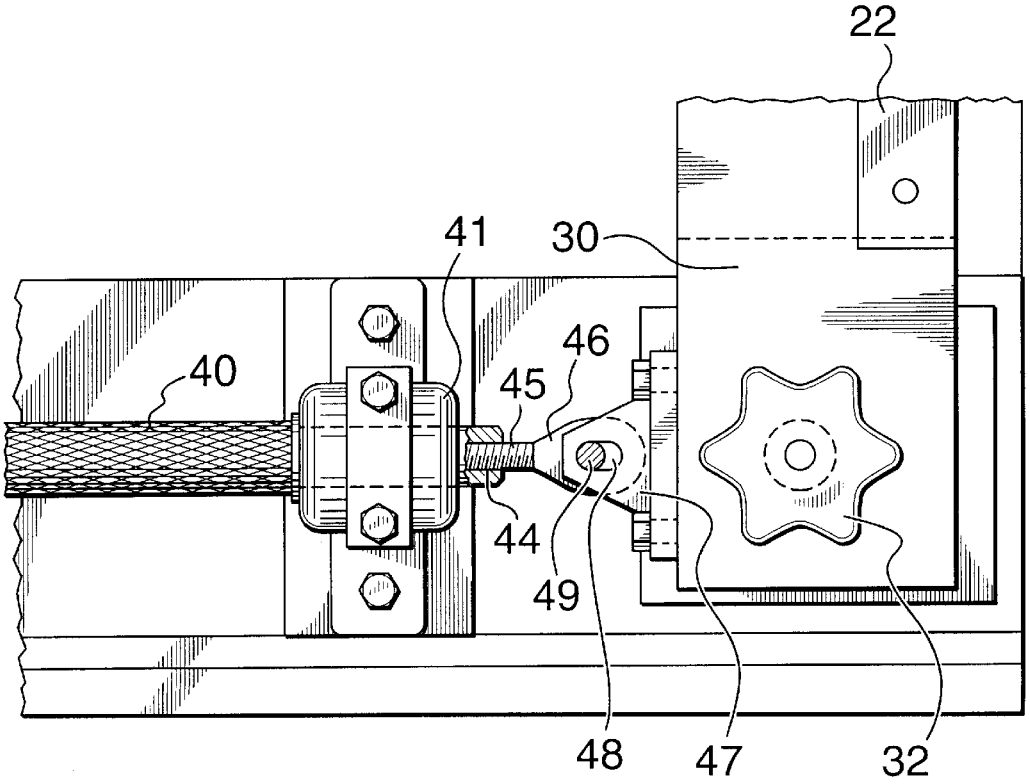
FIG. 5 is a plan view of the actuator of FIG. 4.

The long walls 14 of the mould are equipped with extensions 30 at each end and are shown in more detail in FIGS. 4 and 5. Each extension 30 is in the form of a solid block and includes the post 35 of a screw clamp 32 which is mounted in it and extends down and through a slot 33 in the casting table. The post 35 terminates in head portion 34 so that when the clamp is tightened the head portion 34 bears against the under surface of the table and holds the extension 30 firmly in place. The slot permits the necessary degree of positional change required for different mould sizes.

The mechanism for simultaneously moving the long walls 14 of the mould is also shown in FIGS. 4 and 5. A solid shaft 40 is mounted for rotation in bearings 41, while being fixed against movement in an axially direction. The shaft 40 terminates at each end by an internally threaded hole 44. A bolt 45 is adapted to turn into the threaded hole 44 and this bolt includes a rod end portion 46 through which a clevis pin 49 is mounted. A clevis bracket 47 is connected to the long wall extension 30 and this bracket includes a slotted (or elongated) hole 48 through which the clevis pin 49 extends. This allows for some play between the bolt 45 in the end of shaft 40 and the bracket 47. The threads of the bolts 45 and hole 44 are opposite handed at the two ends of the shaft 40.

The mould apparatus is operated in the following manner. With the screw clamps 29 and 32 loosened, the shafts 40 are rotated (in a "release" direction) by means of a knurled surface so that the long walls 14 of the mould are displaced outwardly. Because of the arrangement of the shaft 40, this displacement is equal for both of the opposing long walls 14 and, therefore, their location remains symmetric about the long axis of the mould cavity. The short wall members 15 can then be moved inwardly or outwardly within the amount of travel permitted by the slots 28. Interchangeable spacers 50 (as shown in FIG. 1) are mounted on pins on the upper surface of the long wall section 14 of the mould and can be used to permit movement of the short walls 15 to predetermined locations. Once the short walls 15 are in position, the screw shafts 40 are again rotated in the opposite direction to bring the long walls back into contact with the short walls. Because the movement is again symmetrical about the long axis of the mould cavity, the mould remains aligned with the long axis of the cavity. With the apparatus of the present invention, there is no need to maintain the end walls 15 in symmetric alignment with the apparatus axis as they are automatically brought into correct alignment by the above operation. This avoids any requirement for fixturing as described in prior art devices where substantial movement was required in the direction of movement of the short walls while very limited movement was required in the perpendicular direction.

When the opposing long walls 14 are brought into good contact with the opposing short walls 15, the screw clamps 29 are then tightened. At this point, the shaft 40 is again rotated slightly in the release direction. Because of the slotted hole 48 in bracket 47, the slight rotation of the shaft permits sufficient play to release any tension on the end extensions 30 of the long walls 14 caused by the shaft and end thread arrangement and any tendency for further outward bowing of the long walls 14. This bowing can introduce additional curvature in the long side of the mould beyond that which is desirable for proper formulation of the metal ingots. The clamp 32 can then be tightened to additionally secure the mould.

Each rectangular mould according to the invention is typically equipped with a vertically moveable bottom block 55 which defines the bottom of the ingot as it is cast. Each bottom block 55 has a long axis which is aligned with the long axis of the mould cavity. At the start of the cast, the bottom block 55 is raised so that it fits within the mould cavity. Because of the close tolerances required, it is essential that the long axis of the bottom block 55 and the long axis of the mould cavity be aligned. The present invention ensures that this occurs, regardless of the size of the mould, by ensuring that the long axis of the mould remains aligned with the long axis of the overall apparatus at all times because of the symmetrical adjustment of the long walls 14.

Figure 8:
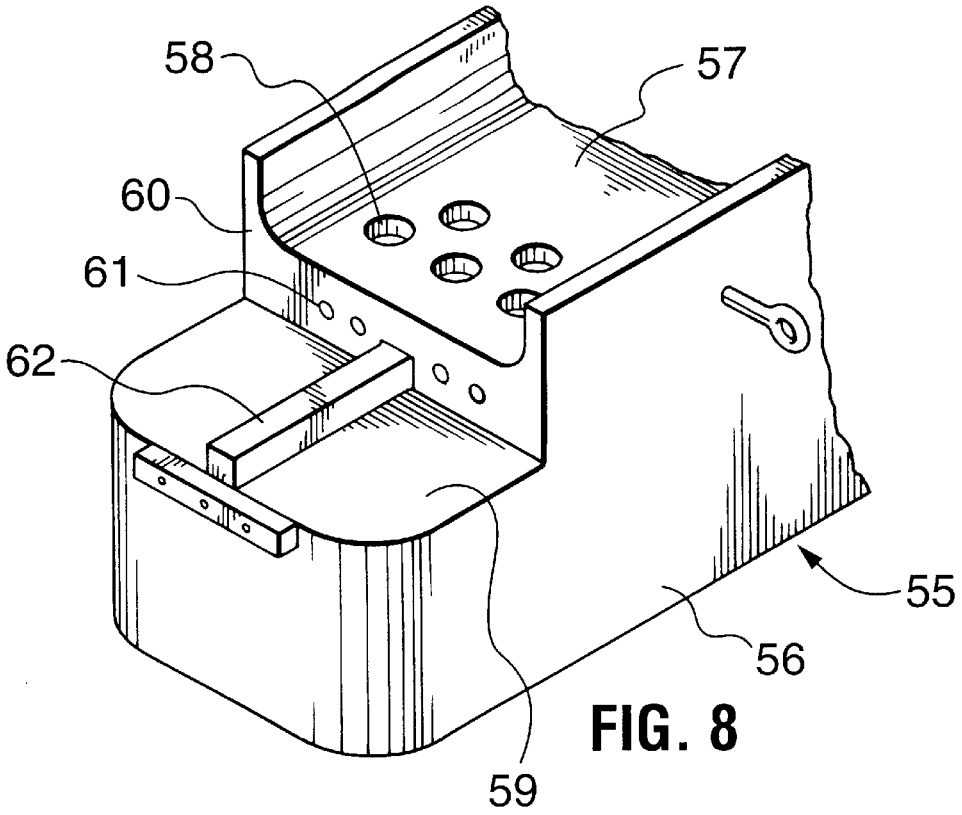
FIG. 8 is a perspective view of a bottom block of the invention.
Figure 9:
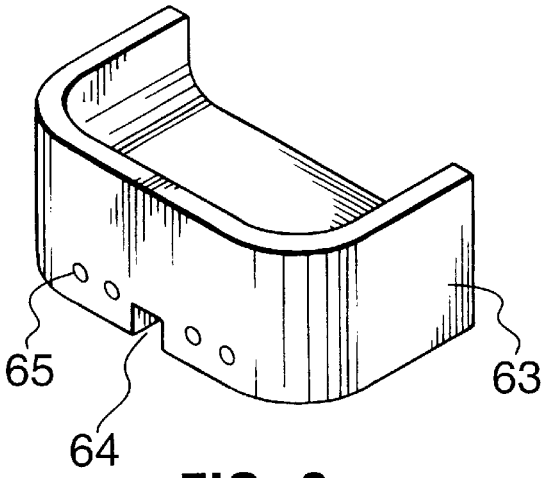
FIG. 9 is a perspective view of an end section of the block of FIG. 8.
Figure 10:
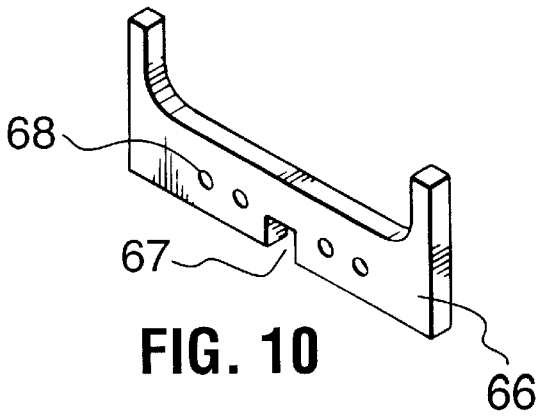
FIG. 10 is a perspective view of a spacer for use with the end section of FIG. 9.

Of course, the length of the bottom block 55 must be adjusted to fit the mould cavity when the short walls are adjusted. A bottom block 55 suitable for this purpose is shown in FIGS. 8, 9 and 10. The bottom block consists of a main body 56 which is mounted on a vertical drive such that its longitudinal axis is aligned with the longitudinal axis of the mould cavity. This bottom block 55 includes a cavity 57 used to form the bottom of an ingot in the early stages of casting and also includes drainage holes 58 which permit secondary coolant that may collect in the cavity to drain away. The block 55 is also equipped with detachable and moveable end sections 63 at each end. To receive these end sections 63, the main body 55 includes a cut away section showing a bottom face 59 and an end face 60. This end face 60 includes a series of threaded holes 61 and a tongue 62 extends upwardly from the bottom face 59.

Each moveable end section 63 includes a groove 64 adapted to mate with the tongue 62 and also includes a series of bolt holes 65 adapted to mate with the threaded holes 61. A series of spacers 66 is also provided, again with a groove 67 to mate with the tongue 62 and bolt holes 68 aligned with the holes 65 and the threaded holes 61. Thus, the spacers 66 may be placed between wall 60 and the end section 63 and the entire assembly bolted together by means of bolts extending through the holes 65 and 68 and into the threaded holes 61. Various thicknesses of spacers 66 may be provided so that the bottom block 55 can be quickly altered in length to match the size of mould selected. The end section 63 and the spacer 66 are shaped such that when the entire assembly is put together a continuous cavity 57 is formed in the top of the bottom block 55.

We claim:

1. A casting apparatus for casting metal ingots of rectangular shape comprising a mould assembly mounted on a casting table, said mould assembly having a pair of opposed, outwardly curved long walls and a pair of opposed short walls defining a rectangular mould cavity, both said opposed short walls and said opposed long walls being moveable to change the size of the cast ingot with the long walls being independently moveable from the short walls, operative means for simultaneously moving the opposed long walls horizontally symmetrically about the longitudinal centre-line of the mould cavity in both inward and outward directions, and said opposed short walls being adapted to move horizontally in both inward-outward and lateral directions and a vertically moveable bottom block adapted to move downwardly and support a forming ingot.

2. A casting apparatus according to claim 1 wherein the opposed short walls are mounted in continuously adjustable clamps which permit continuous adjustment between the limits of travel.

3. A casting apparatus according to claim 2 wherein the continuously adjustable clamps are in the form of a screw clamp operating within slots which limit the distance of movement of the walls.

4. A casting apparatus according to claim 1 wherein the opposed long walls are mounted in continuously adjustable clamps.

5. A casting apparatus according to claim 4 wherein the continuously adjustable clamps are in the form of screw clamps operating in slots which limit travel.

6. A casting apparatus according to claim 1 wherein the operative means for simultaneously moving the opposed long walls comprises mechanical means.

7. A casting apparatus according to claim 6 wherein the mechanical means comprises a pair of actuating shafts with threaded end portions extending across between the long walls at opposite ends thereof, said threaded shafts being rotatable while being fixed against axial movement and the threaded end portions thereof engaging threaded members attached to said long walls.

8. A casting apparatus according to claim 7 wherein the threaded end portions comprises internally threaded holes extending axially into the ends of the shaft and the threaded members attached to said long walls are flexibly attached to said long walls.

9. A casting apparatus according to claim 8 wherein the threaded member attached to said long walls comprises a threaded bolt terminating in a rod end through which a clevis pin is mounted, said clevis pin fitting through a hole in a clevis block which is fixedly attached to said long wall.

10. A casting apparatus according to claim 9 wherein the hole in the clevis block is elongated to allow lateral play.

11. A casting apparatus according to claim 1 wherein the mould short walls include at the ends thereof corner coolant deflectors for deflecting coolant away from corners of a forming ingot.

12. A casting apparatus according to claim 1 wherein the mould short walls are suspended from slidable supports adapted to slide on the top surface of the mould long walls.

13. A casting apparatus according to claim 12 wherein oil plates are provided on the top surfaces of the mould walls and the slidable supports are adapted to slide on said oil plates.

14. A casting apparatus according to claim 13 wherein each slidable support includes a surface which is adapted to bear against an oil plate of a long wall to seal adjacent grooves and thereby prevent oil leaks.

15. A casting apparatus according to claim 14 wherein the surface includes a sealing material.

16. A casting apparatus according to claim 1 wherein the bottom block includes end sections which are moveable to lengthen or shorten the block, said end sections being slidable via tongue and groove supports and spacers for inserting between the end sections and the remainder of the bottom block.

17. A casting apparatus according to claim 3 wherein the slots are adapted to permit both inward-outward and lateral movement of the opposed short walls.

* * * * *